US006971613B2

(12) United States Patent
Shendelman

(10) Patent No.: US 6,971,613 B2
(45) Date of Patent: Dec. 6, 2005

(54) PLATE STAND

(76) Inventor: Leonid Shendelman, 2355 E. 12th St., Apartment No. 5K, Brooklyn, NY (US) 11229

( * ) Notice: Subject to any disclaimer, the term of this patent is extended or adjusted under 35 U.S.C. 154(b) by 0 days.

(21) Appl. No.: 10/758,567

(22) Filed: Jan. 14, 2004

(65) Prior Publication Data

US 2005/0151034 A1 Jul. 14, 2005

(51) Int. Cl.[7] ..... A47G 19/02

(52) U.S. Cl. ..... 248/150; 248/154; 248/161; 248/177.1; 211/41.2; 211/85.4; 211/196; 211/205; 220/575

(58) Field of Search ..... 248/149, 150, 248/161, 158, 176.1, 176.2, 177.1, 186.1, 248/186.2, 154; 220/574, 574.1, 574.2, 574.3, 220/575; 211/41.1, 41.2, 41.7, 85.4, 196, 211/205

(56) References Cited

U.S. PATENT DOCUMENTS 2,372,073 A * 3/1945 Flournoy ..... 248/149
3,283,913 A * 11/1966 Horn, Jr. ..... 211/78
3,295,671 A * 1/1967 Wuensch et al. ..... 206/763
3,414,133 A * 12/1968 Guerri et al. ..... 211/107
3,613,901 A * 10/1971 Montelius ..... 211/166
4,865,283 A * 9/1989 Parker ..... 248/159
5,458,243 A * 10/1995 McBride ..... 206/503
5,538,145 A * 7/1996 Held ..... 211/41.2
5,542,731 A * 8/1996 Wills ..... 294/161
5,577,344 A * 11/1996 Zaremba et al. ..... 47/39
5,715,954 A * 2/1998 Zaremba ..... 211/107
5,772,050 A * 6/1998 Shih ..... 211/39
5,873,312 A * 2/1999 Mauro-Vetter ..... 108/147.21
5,934,634 A * 8/1999 Lindblom ..... 248/230.1
6,308,838 B1 * 10/2001 Endean ..... 211/37

FOREIGN PATENT DOCUMENTS

GB 596609 A1 * 5/1994

* cited by examiner

*Primary Examiner*—Jonathon Szumny
(74) *Attorney, Agent, or Firm*—Kirschstein, et al.

(57) ABSTRACT

A plate is detachably mounted on a portable support capable of holding a beverage and other accessories, especially eating utensils.

12 Claims, 12 Drawing Sheets

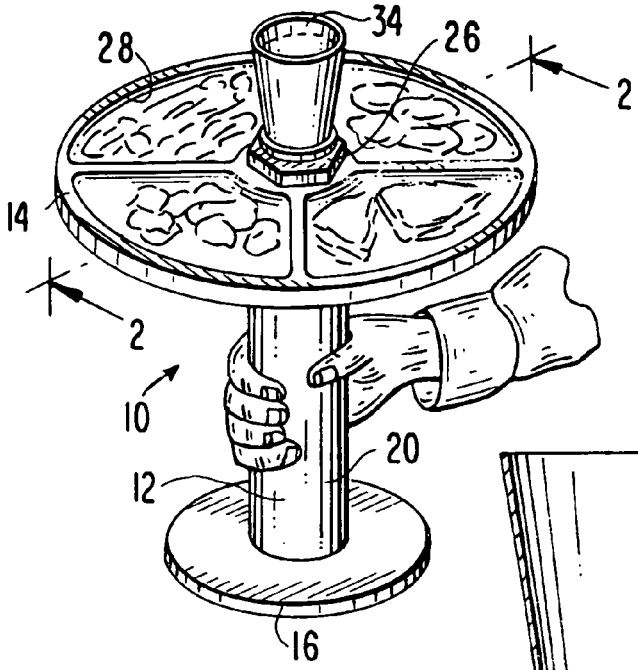
FIG. 1
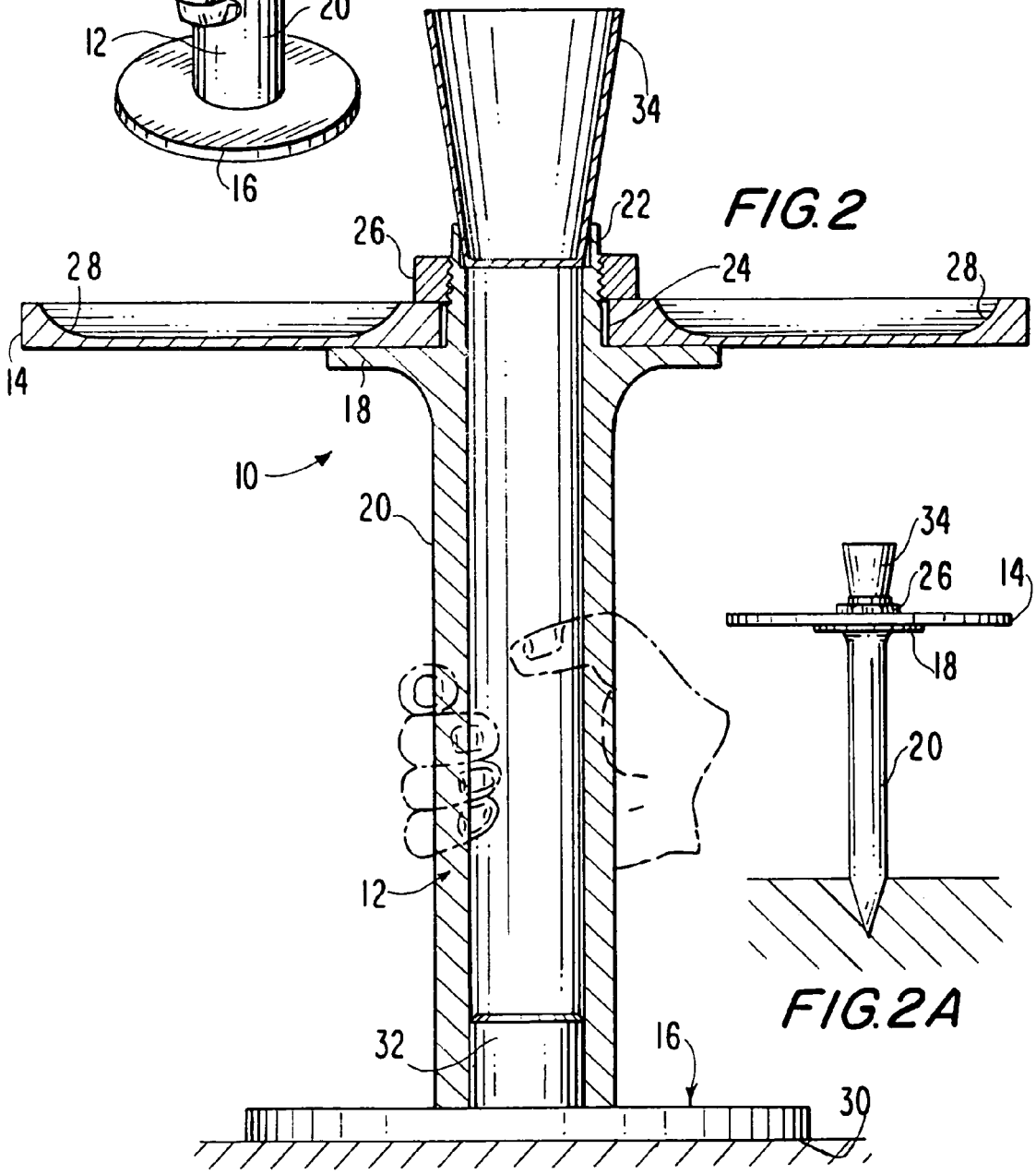
FIG. 2
FIG. 2A

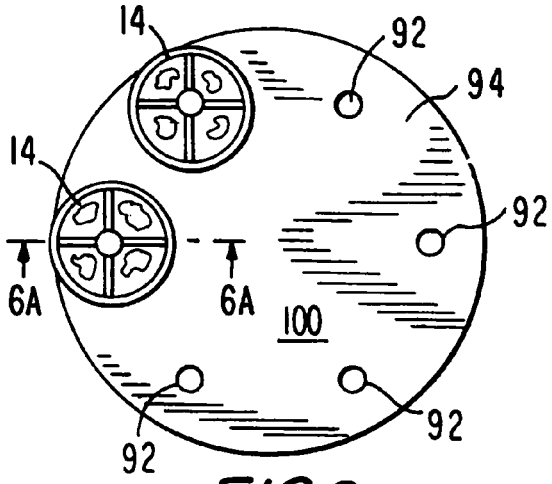
FIG.6
FIG.6A
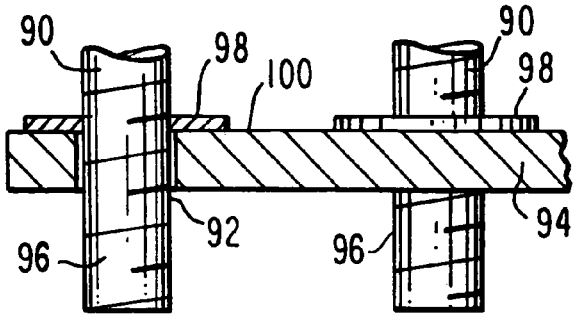
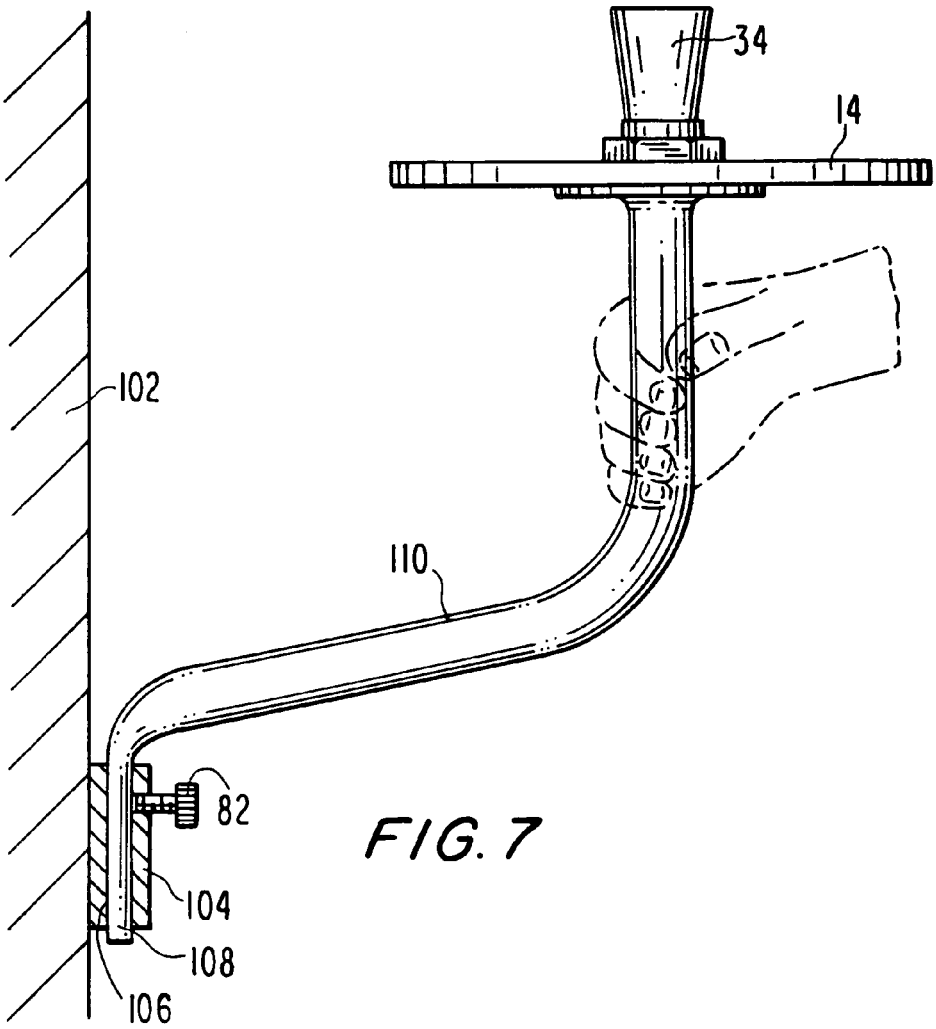
FIG. 7

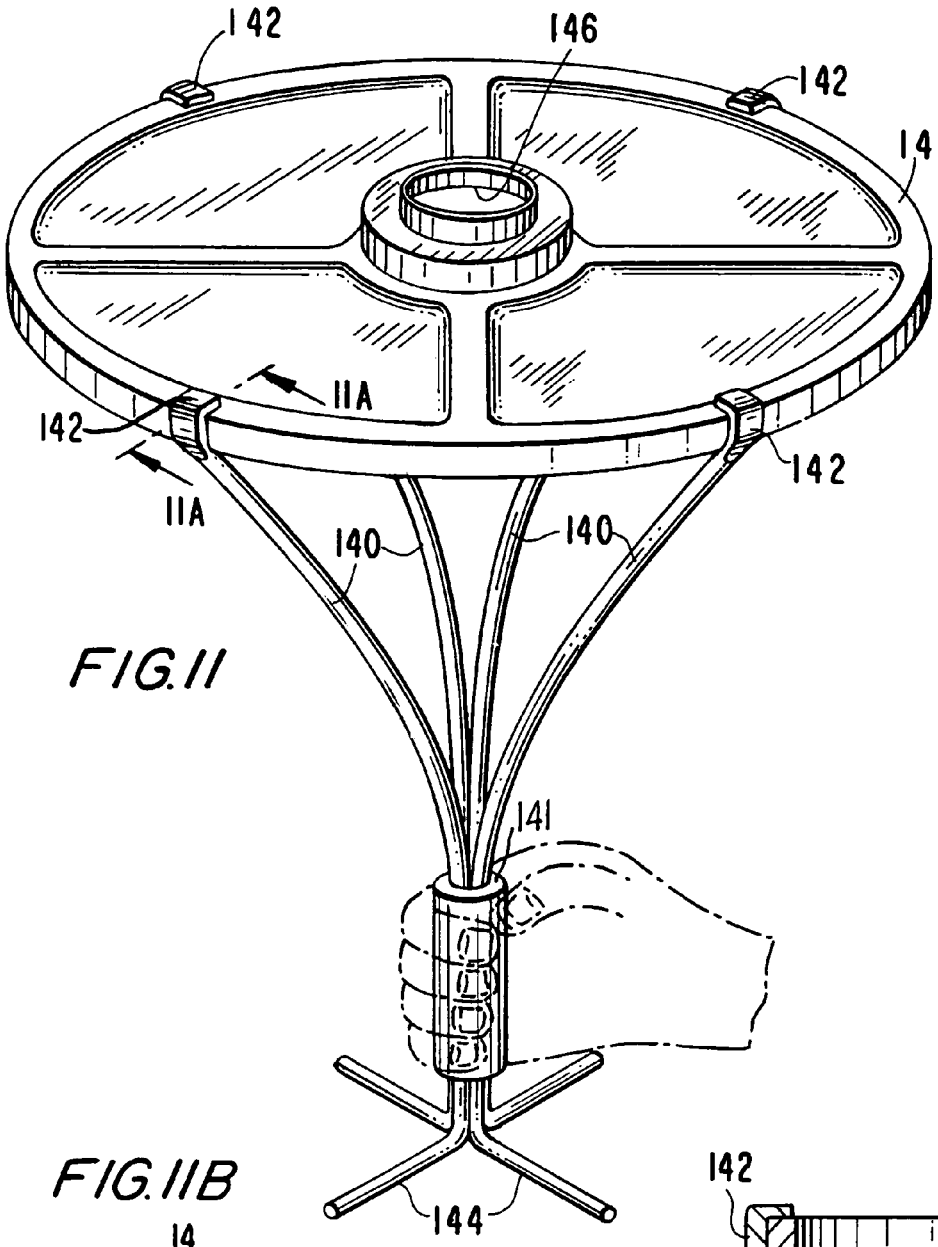
FIG.11
FIG.11B
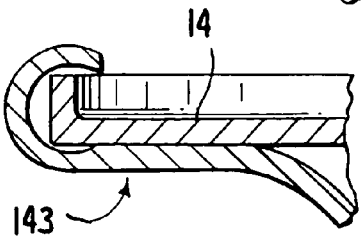
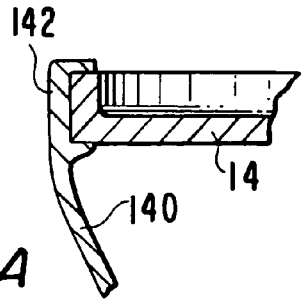
FIG.11A

FIG. 14
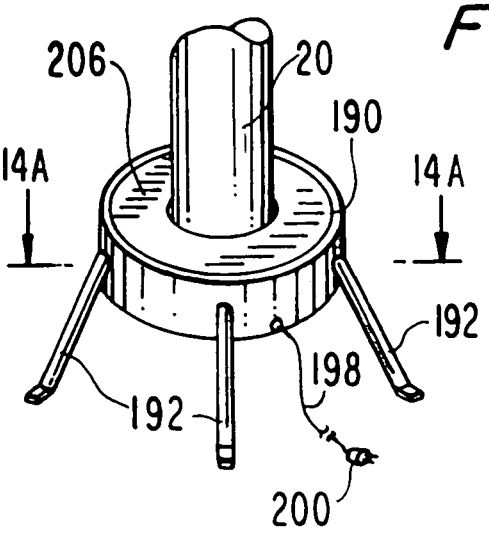
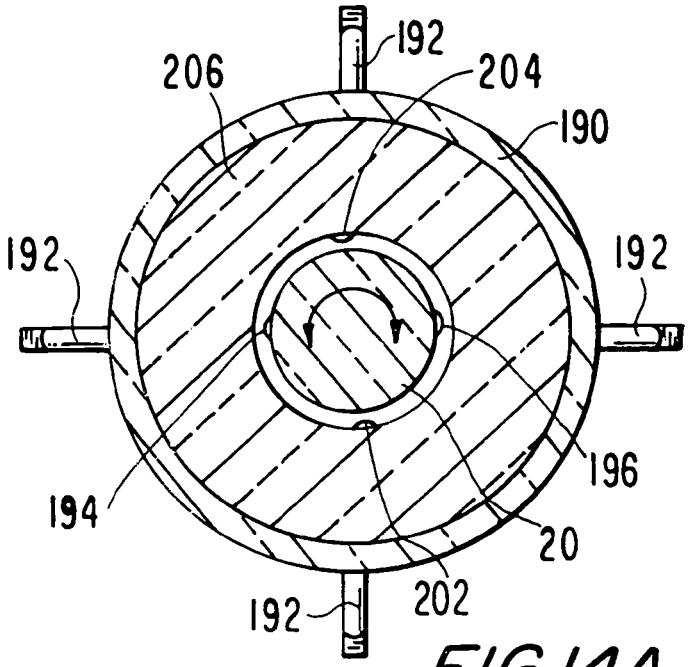
FIG. 14A
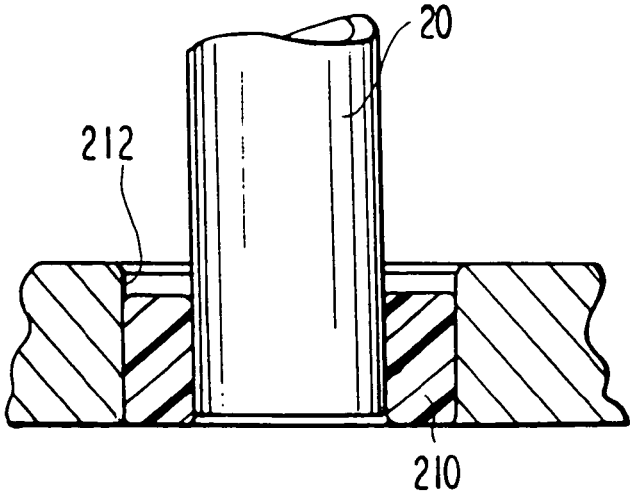
FIG. 15

PLATE STAND

BACKGROUND OF THE INVENTION

1. Field of the Invention

The present invention generally relates to a plate stand especially for use at social gatherings at which food and drink are served buffet style.

2. Description of the Related Art

Guests fill their plates with food at social functions, and typically either hold their plates in cantilever fashion by gripping peripheral edges of the plates, or balance their plates on their laps or on their outstretched hands underneath the plates. If drinks are also served, the guests hold their beverage containers in their other hands, or balance the containers on their plates. Due to the difficulty in performing such balancing, guests often seek out a table or like supporting surface, or even the floor, to support their beverage containers. Yet, this tends to anchor guests to a specific location and prevents the guests from roaming and socializing.

SUMMARY OF THE INVENTION

Objects of the Invention

One object of this invention is to enable a beverage container and a food plate to be securely mounted on a stand that can easily be moved from place to place without spilling the beverage or the food.

Another object of this invention is to provide a plate stand on which a plate is readily detachable.

Still another object of this invention is to provide a plate stand that can readily hold with one hand a plate, a beverage container and eating accessories, such as utensils and napkins.

Yet another object of this invention is to provide a plate stand with illumination.

An additional object of this invention is to provide a weight-balanced, symmetrical stand for reliably holding objects, such as food and/or beverage containers, without tipping over.

Still another object of this invention is to provide a stand of adjustable height and lockable at a selected height.

Yet another object of this invention is to provide a portable stand capable of warming or cooling or protecting food placed on a plate thereon.

An additional object of this invention is to provide a stand capable of being supported in myriad ways, for example, on a floor, table or like horizontal support surface, or on a wall or like vertical support surface, or on a user in a body supported harness, belt or like wearable support, or in the ground, or in a vehicle.

Yet another object of this invention is to provide a stand for holding an object thereon during transport of the stand from place to place, or at rest, thereby serving as a transportable desk.

Still another object of this invention is to provide a portable plate stand which is simple in construction, inexpensive to manufacture, and convenient to use.

FEATURES OF THE INVENTION

In keeping with these objects, one feature of this invention resides, briefly stated, in a plate stand having a support with an elevated holder, and a plate detachably mounted on the holder. The plate may support any object, and in the preferred embodiment, has at least one food compartment for holding food. The detachable mounting of the plate enables the food plate to either be cleaned for re-use, or preferably discarded and replaced by a fresh plate.

In accordance with the invention, the support includes an upright, preferably hollow, cylindrical column extending between a base and a platform. Preferably, the column has a diameter sized to be gripped around by a human hand. Alternatively, a handle can be mounted on the column. The column can be adjustable in height and locked in position at a selected height.

An upper end region of the column extends through a central aperture in the plate. This upper end region may be threaded, in which case, a threaded nut is preferably threaded onto the upper end region to clamp the plate between the nut and the platform.

The upper end region of the column has an open end into which a beverage may be poured to fill the interior of the column. A straw may be inserted into the open end to enable one to drink the beverage filling the interior of the column. Preferably, a beverage container is inserted with a friction fit into the open end of the column. This enables the container to be held securely while the stand is being transported, and to be removed readily from the stand for drinking. Alternatively, food and/or beverage containers may be positioned inside the column.

In another embodiment, instead of inserting a beverage container into the open end of the column, a light source, such as an electrical bulb, or one or more light emitting diodes, or a candle, could be mounted at the open end to provide the plate stand with local illumination. The illuminated stand is particularly desired for social parties with the ambient lights dimmed or at night. A light shade is useful for dimming the glare of an energized light bulb.

Accessories can also be mounted on the stand. For example, eating utensils, such as knives, forks and spoons, can be detachably mounted on the stand, especially on the column. In some cases, the utensils can be mounted on the plate, for example, by being inserted through holes in the plate, or by being frictionally held between projections on the plate. The utensils, as well as napkins and the like, can also be mounted on a side platform which is preferably movably mounted on the column. The side platform can be used to support other items, such as business cards, brochures, literature and the like, as well as electronic devices such as telephones, personal digital assistants, computers and the like. The side platform could also be configured as an ashtray. The side platform is preferably interchangeably mounted on the column by a linkage or a gooseneck tube, which allow the side platform to be moved to, and held in, a desired position and orientation.

The stand can be directly mounted on a generally horizontal support surface such as the floor or a table, or on a generally vertical support surface such as a wall, or on a user with the aid of a belt or like body harness, or in the ground, or in a vehicle console, or in an adapter. The table can be outfitted with one or more mounting holes in which a lower end of the column is inserted. An abutment is adjustably mounted on the column and limits the depth of insertion of the column and resists tipping.

The stand can be provided with resistive wires supplied by electrical current from an on-board battery or from a battery recharger to heat food placed on the plate. A cooling unit can likewise be incorporated in the stand to cool food placed on the plate. A curtained enclosure may surround the food to protect the same until it is ready to be eaten.

In still another embodiment, the column itself can be replaced by a plurality of containers, preferably each containing a beverage, the containers being stacked vertically and interconnected. Alternatively, the containers can be inserted into the interior of the column and removed as necessary. Other items, such as flowers, banners and promotional items can also be inserted into the upper open end of the column for display purposes.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a perspective view on a reduced scale of a plate stand in accordance with one embodiment of this invention;

FIG. 2 is an enlarged, sectional view taken on line 2—2 of FIG. 1;

FIG. 2A is a side elevational view on a reduced scale of another embodiment of this invention;

FIG. 6 is a top plan view of a plurality of plate stands in accordance with another embodiment of the invention mounted on a table;

FIG. 6A is a sectional view taken on line 6A—6A of FIG. 6;

FIG. 7 is a view of a stand in accordance with this invention shown mounted on a wall;

FIG. 11 is a perspective view of another embodiment of a plate stand according to this invention;

FIG. 11A is a sectional view taken on line 11A—11A of FIG. 11;

FIG. 11B is a view analogous to FIG. 11, but of a modification;

FIG. 14 is a perspective view of an adapter for supporting a plate stand according to this invention;

FIG. 14A is a sectional view taken on line 14A—14A of FIG. 14; and FIG. 15 is a part-sectional view of an additional embodiment of this invention.

DETAILED DESCRIPTION OF THE PREFERRED EMBODIMENTS

Figures 3, 3A, 3B:
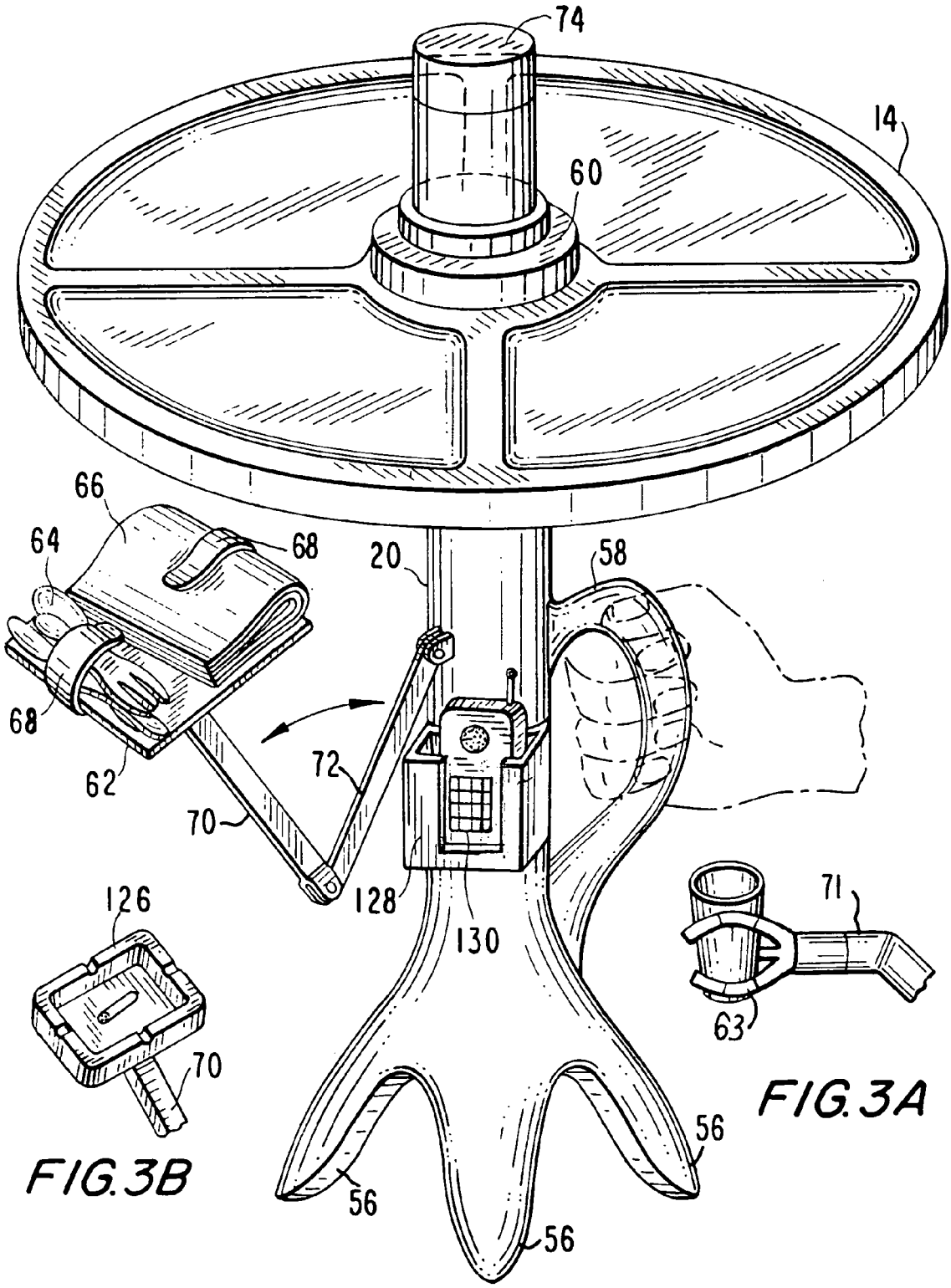
FIG. 3 is a perspective view of a plate stand in accordance with another embodiment of this invention.
FIGS. 3A and 3B are perspective views of alternative details for the embodiment of FIG. 3.

Reference numeral 10 in FIGS. 1–2 generally identifies a first embodiment of a plate stand having a support 12 and a plate 14 detachably mounted thereon. The support 12 includes a base 16, a platform 18, and an upright column 20 extending vertically between the base and the platform. An upper end 22 of the column extends through and past an aperture 24 centrally located in the plate.

As shown in FIG. 2, the upper end 22 is externally threaded, and an internally threaded annular element or nut 26 threadedly engages the upper end 22. The plate 14 is clamped between the nut 26 and the platform 18 to securely hold the plate in position. When the nut is unthreaded, the plate is readily removable from the stand for cleaning or for replacement with a fresh plate. Clamping elements, other than threaded nuts, could also be employed.

The plate itself may be made of a disposable material such as paper, or of a permanent material such as metal, plastic, or porcelain. The plate can hold any object, for example, a computer, a writing pad, or personal digital assistant to serve as a desk, but preferably has at least one compartment 28, and preferably a plurality of compartments, for holding food. Each compartment may be sector-shaped as shown, and one of the compartments may be circular for receiving a beverage container. Preferably, the plate is microwavable for preheating food prior to placement on the stand.

Figure 5:
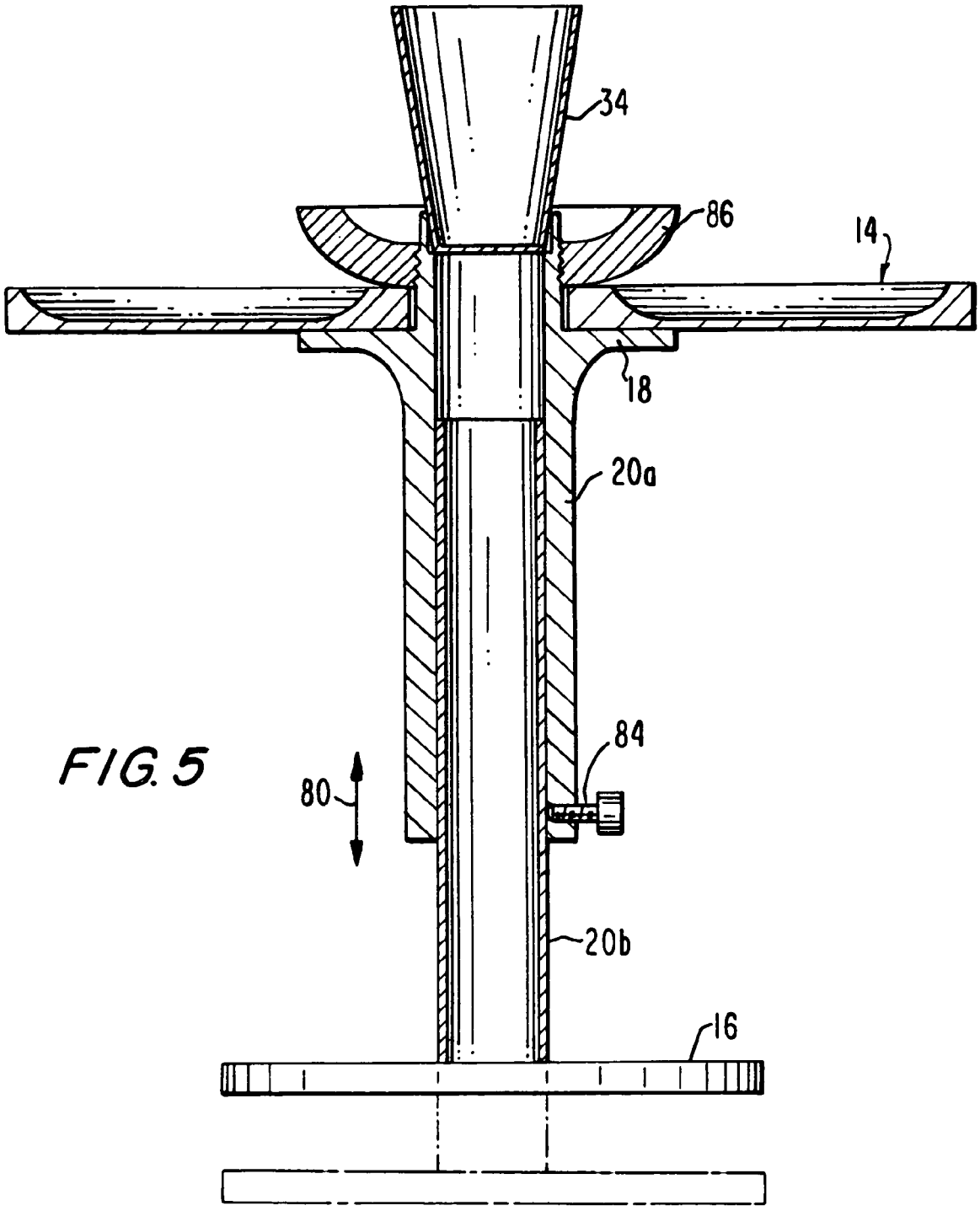
FIG. 5 is a view analogous to FIG. 2 of another embodiment showing a column of adjustable height and lockable in a selected position.

The column 20 between the base and the platform is preferably a hollow cylinder and has a diameter sized to be readily gripped in the palm of a user's hand. The length of the column can be fixed (FIG. 2) or adjustable (FIG. 5). As described below, when the stand is intended to be placed on a table, the length is shorter than when the stand is to be placed on the floor. For ease of adjustability, the column can be constructed of a plurality of tubular sections telescopingly arranged for sliding lengthwise movement relative to one another and locked together by friction or a lock.

The base 16 in FIG. 2 has a planar bottom surface 30 for stable mounting on the floor or a table, and a stub shaft 32 for detachable mounting in the column. The base could also be of one-piece with the column. As shown in FIG. 2A, the lower end of the column could advantageously be tapered and staked into the ground. The tapered lower end of the column can be either integral with the column, or a separate detachable part interchangeable with the base 16. The lower end of the column could also be placed in circular mounting holes provided in a table or like support surface, as described below in connection with FIG. 6.

The platform 18 could likewise be a separate, detachable element. For example, the platform could be another annular element similar to nut 26, but which engages the plate from below. The platform could either be fixed, or movable relative, to the column.

The upper end 22 of the column is open and, thus, is free to receive items. For example, a beverage container 34, as shown in FIG. 2, may be inserted and held with a friction fit inside the upper end 22. The container 34 has a frusto-conical cross-section which is wedged into the constant, circular cross-section of the upper end 22. The container may be removed and replaced at will.

In another embodiment, a beverage may be directly poured into the hollow interior of the column, and a straw inserted through the open upper end 22 to permit a user to drink the beverage through the straw. Instead of a straw, a tap may be provided at a lower end of the column to allow the beverage within the column to be drawn off at a controlled rate into a container when the tap is opened.

Figure 4:
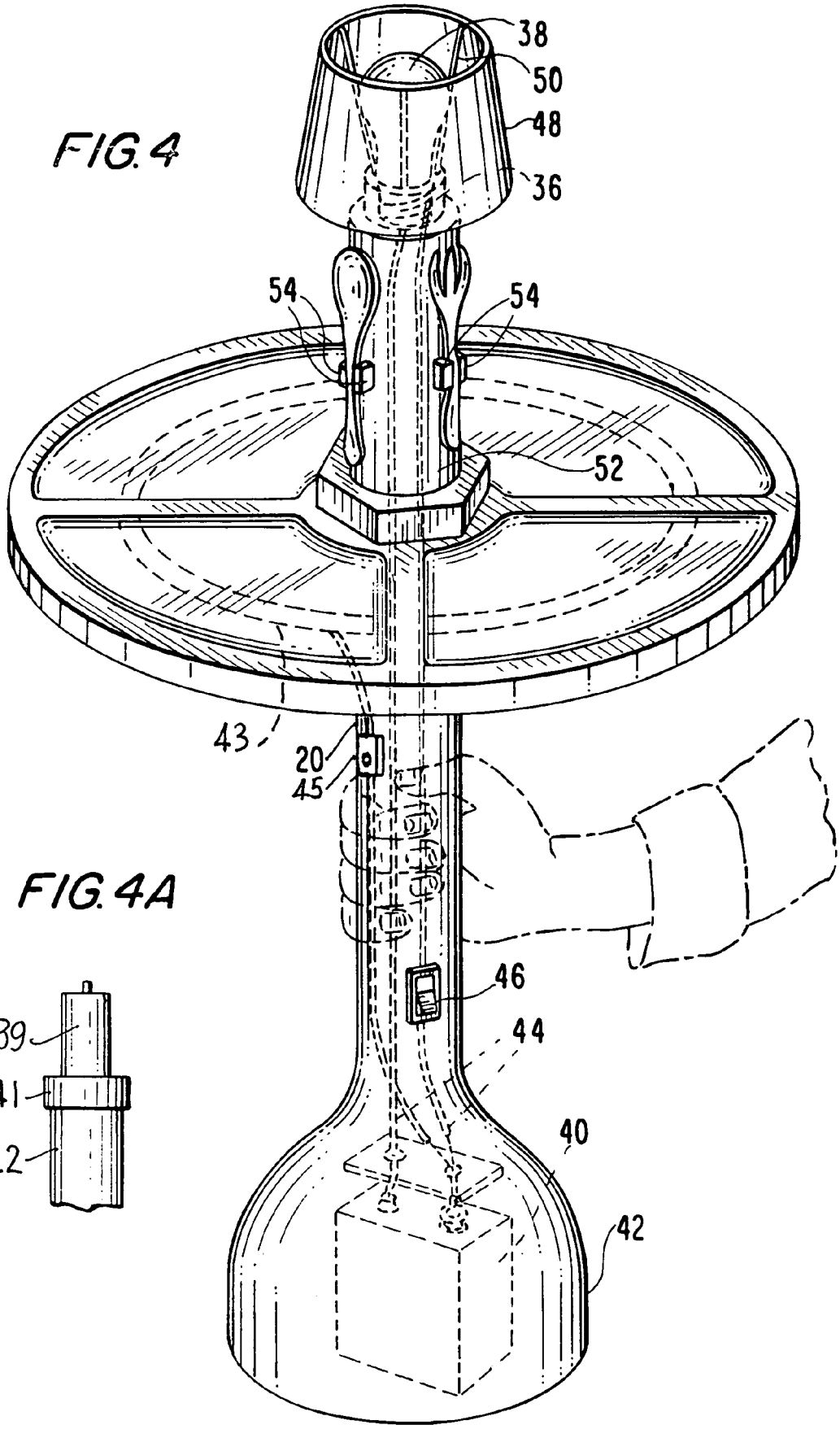
FIG. 4 is a perspective view of a plate stand in accordance with yet another embodiment of this invention.

As shown in FIG. 4, an electrical light bulb socket 36 may be mounted at the upper end 22 of the column. A light source such as a light bulb 38 is mounted in the socket 36. A battery 40 is mounted on the stand, preferably within an enlarged hemispherical base 42. Electrical wires 44 are routed through the hollow column to the socket to energize the bulb under the control of an on-off switch 46. The light emitted by the energized bulb may be moderated by a shade 48 mounted by a harp 50 on the stand. The shade 48 is preferably made of a light-diffusing material. The illuminated stand of FIG. 4 is of particular utility in darkened environments when the ambient lighting is dimmed, or turned off, or at night, and sets a romantic mood for a social gathering.

Figure 4A:
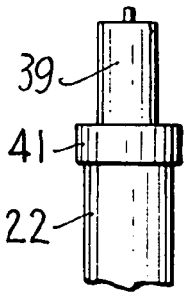
FIG. 4A is a side elevational view of another embodiment of this invention.

Light sources other than a bulb can be used. For example, one or more light emitting diodes, or low wattage lamps, preferably arranged in a candelabra fixture, can be employed. Also, one or more candles could be used as the light source, again arranged in a candleholder, preferably having multiple branches. For example, FIG. 4A depicts a candle 39 mounted in a holder 41 at the upper end 22 of the column.

Other items could be inserted into the open upper end 22. For example, stemmed flowers 124 (see FIG. 8) could be inserted into the end 22 to serve as a decorative bouquet. An umbrella could be inserted into the end 22 to provide shade from the weather, such as sun or rain. A pole on which a flag or advertising banner is mounted can be inserted into the end 22.

As depicted in FIG. 4, the upper end 22 has an extension 52 which extends for a greater distance above the plate as compared to FIG. 1. The extension 52 has a plurality of pairs of utensil holders 54, each pair being operative for frictionally holding a utensil, such as a knife, fork or spoon. Alternatively, the utensil holders could be mounted on the column underneath the plate. Another type of holder can be a resilient band surrounding the extension 52 or the column 20, the band resiliently pressing any item against the extension or column.

The embodiment of FIG. 3 is similar to that of FIG. 1, except in the following respects. Instead of having a flat bottom surface 30, the base has a plurality of legs 56. Instead of gripping the column around its outer cylindrical wall, a handle 58 is connected to, and extends outwardly of, the column. Instead of the nut 26 having a polygonal outer periphery, a nut 60 has a circular periphery, and its exterior surface is roughened, for example, by ribbing, to enhance one's grip thereon. Instead of a frusto-conical, open beverage container, a thermos container 74 can be removably mounted in a cylindrical sleeve of the annular member 60.

FIG. 3 also depicts a side holder 62 on which various items, such as eating utensils 64 and napkins 66, are held by clips 68. The side holder 62 is mounted on the stand for movement relative thereto. For example, a pair of links 70, 72 is interconnected between the side holder and the column, and is frictionally held in any position relative to the stand. Instead of links, a flexible gooseneck extension 71 (see FIG. 3A) can be used to move the side holder to, and held in, any desired position and orientation. The side holder can be used to hold any item, including, for example, business cards, seating assignments, menus, cellular telephones, personal digital assistants and the like. The movement is preferably manual, but can be automatic under control of an electronic circuit, preferably one that is voice responsive. The side holder can be a planar platform as shown in FIG. 3, or a robotic hand 63 as shown in FIG. 3A. It is especially useful if the side holder is configured as a tray 126 (see FIG. 3B) for receiving ashes and/or for holding cigarettes and the like. The side holder, as well as its support, are detachable for replacement with other accessories as needed for a particular occasion.

In addition, a storage compartment 128 is mounted on the column 20 for removably receiving additional items, such as a telephone 130. The telephone can be loosely received in the compartment as shown in FIG. 3, or can be snugly received in which case the compartment serves as a resilient clip. Preferably, the telephone can be operated without its removal from the storage compartment and, for that purpose, an opening in the front wall of the compartment is wide enough to enable ready access to all keys and buttons on the telephone received therein.

The base need not rest directly by gravity on the floor or a table, but could be equipped with an affirmative holder, such as a magnet for being magnetically attracted and held to a metal supporting surface, or a suction device for being attracted with a suction force to and being held on any surface. The base could also be equipped with a clamp or analogous fastener for fastening the stand to any structure, including, for example, a chair. The base could also be provided with wheels (see FIG. 10) to allow the stand to be rolled from place to place.

As used herein, the term plate is not to be limited to a circular dish, but can cover any shape, including bowls and trays of any shape. The plate is also not intended to be limited to food holders. The plate need not be fixed in position by the nuts 26, 60, but can be allowed to have freedom of turning movement about an axis extending lengthwise of the column.

The upright column is not to be limited to a cylinder, but can be of any shape, including sculptures of people, places and things, landmarks, souvenirs, buildings, and need not be hollow.

The embodiment of FIG. 5 is analogous to that of FIG. 2 except in the following respects. First, the column is not a single cylinder, but comprises a pair of telescoping sections 20*a*, 20*b* slidable lengthwise in the directions of double-headed arrow 80. A locking pin 84 is inserted through a hole 82 in section 20*a* into pressing engagement with the sidewall of section 20*b*, thereby adjusting the overall length of the telescoping sections. Secondly, the base 16 is shown integral with the section 20*b*. The FIG. 5 embodiment is advantageously able to rest on the floor or on a table due to its adjustability. Thirdly, a nut 86 is shown having a bowl-shaped configuration to collect liquid spillage from the container 34.

The embodiment of FIGS. 6–6A depicts a lower end 90 of the column specially adapted to be received in a selected mounting hole 92 of a table 94. The table 94 can be circular, rectangular, or any shape with a plurality of mounting holes 92 spaced apart. The lower end 90 has a projection 96 and an abutment 98 that rests on an upper surface 100 of the table. The abutment 98 limits the depth of insertion of the projection and also affirmatively prevents the stand from tipping. The abutment 98 can be integral with, or threaded onto, the column end 90. The abutment 98 is adjustably positionable along the column and can be of any shape, and can be replaced, for example, by a pin. The adjacent mounting holes 92 are spaced sufficiently apart to prevent their respective plates 14 from touching. Rather than a table, the holes could be formed in a countertop in a restaurant, or in the floor or ground.

The embodiment of FIG. 7 depicts the beverage container 34 and the plate 14 mounted on a column which is adapted to be mounted on a vertical support surface, such as wall 102. A bracket 104 is mounted on the wall and has a mounting passage 106 through which a lower end 108 of an S-shaped column 110 is inserted. A lock 82 fixes the lower end 108 in position to prevent undesired movement. Preferably, multiple brackets are spaced along the wall to accommodate multiple stands.

Figure 8:
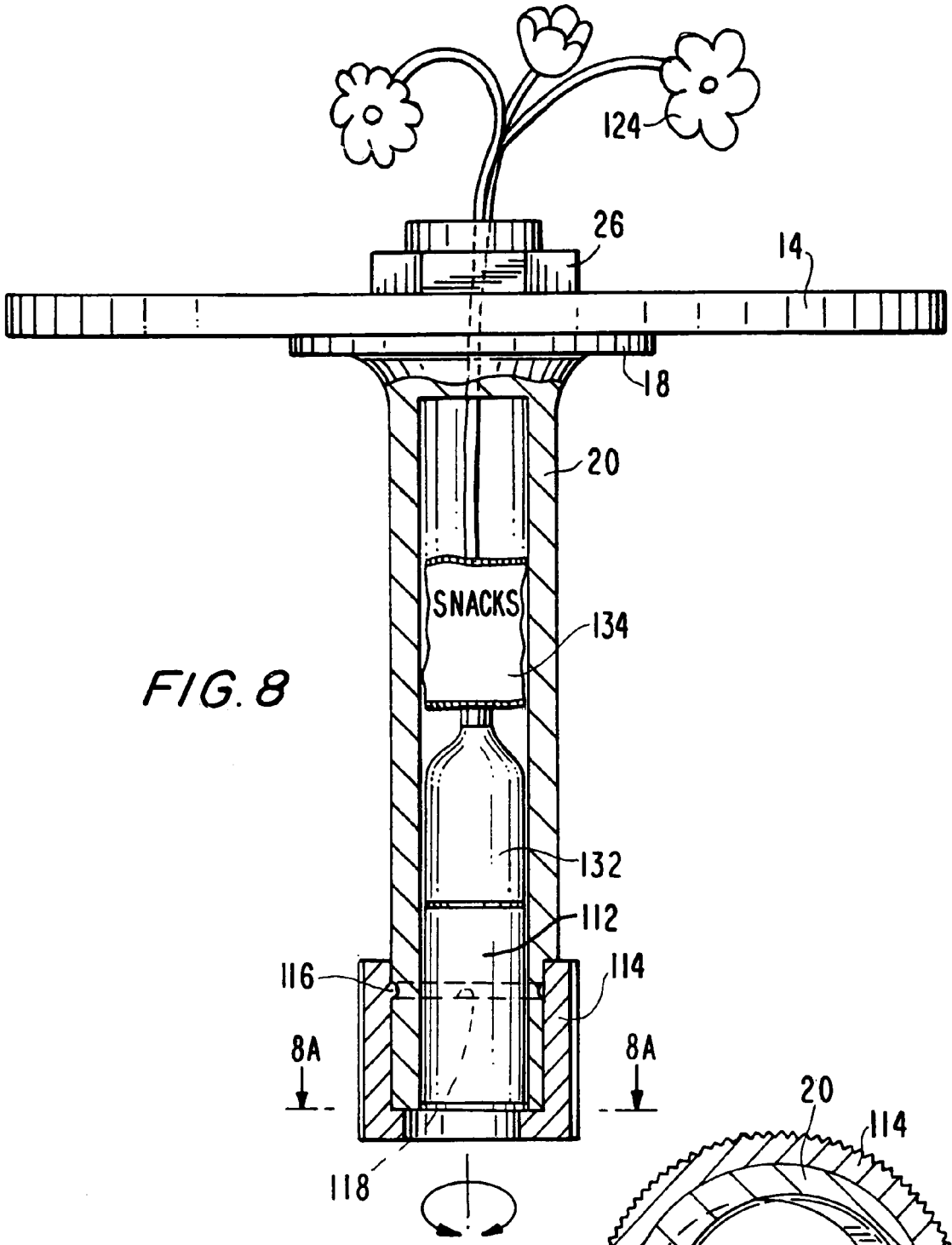
FIG. 8 is a view analogous to FIG. 2 of still another embodiment showing a plurality of foodstuffs within the hollow column.
Figure 8A:
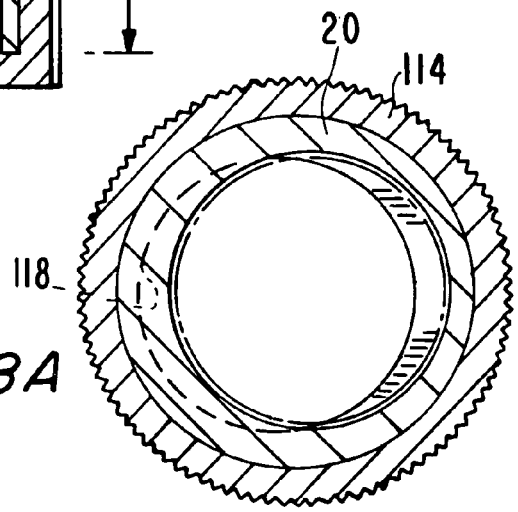
FIG. 8A is a sectional view taken on line 8A—8A of FIG. 8.

The embodiment of FIG. 8 is analogous to that of FIG. 2, except that the interior of the column is filled with a vertical stack of foodstuffs, such as beverage can 112, beverage bottle 132, a bag 134 of chips or candy, condiments, and like snacks, including non-foodstuffs such as a prize or toy. An end cap 114 has an internal bead 116 that is threaded into a helical groove 118 (see FIG. 8A) around the lower end of the column. A snap-on end cap 114 can also be employed. The column may be made of a light-transmissive material to enable viewing of the items stored therein.

Figure 9:
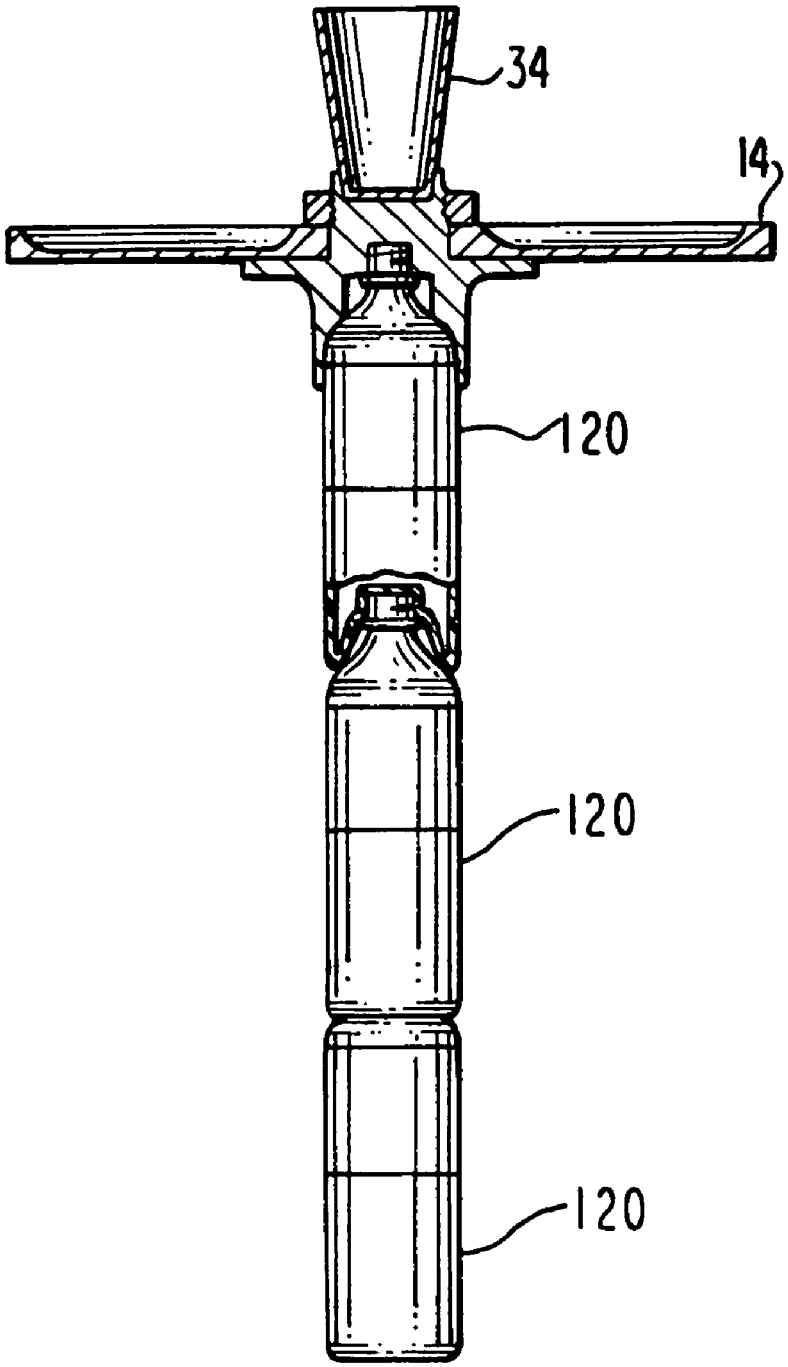
FIG. 9 is a view of yet another embodiment in which the column is comprised of a stack of beverage containers.

FIG. 9 depicts an embodiment in which a vertical stack of interfitting beverage containers 120 constitutes the column itself. The bottom of each container 120 has an internal thread or snap-in groove into which an external bead on a cap of an adjacent container is engaged.

Figure 10:
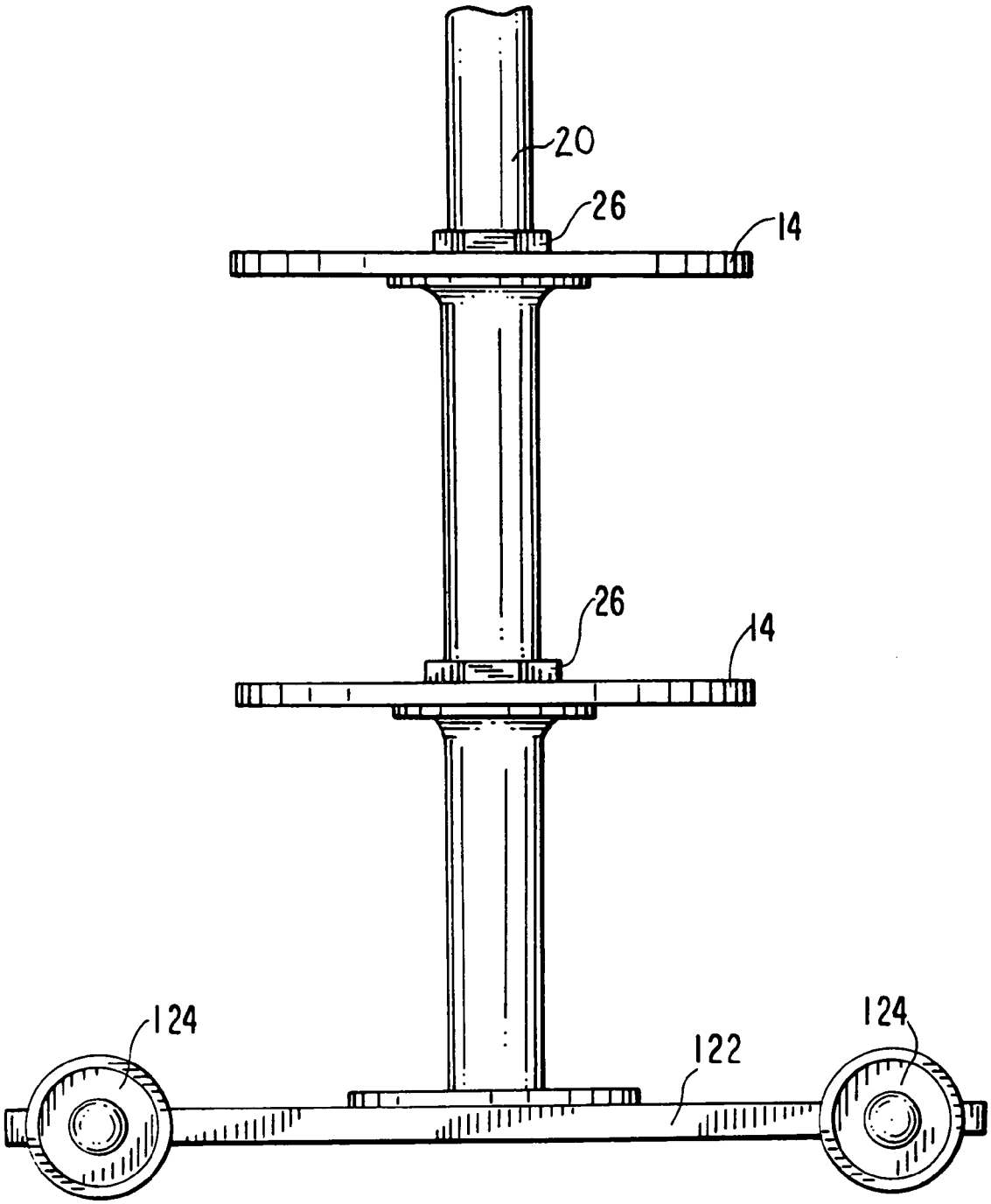
FIG. 10 is an elevational view of an additional embodiment in which multiple plates are stacked one above another on a dolly.

FIG. 10 depicts an embodiment in which multiple stands are vertically arranged and supported on a dolly 122 having wheels 124 for rolling movement from place to place, especially in a restaurant.

It will be recalled that the center of the plate 14 has a hole 24. Once the plate is removed from the support, this hole 24 serves as a convenient hole through which a person's thumb can be inserted for secure handling of the plate.

As depicted, the beverage container 34 is mounted in the upper open end of the column. The container could equally well be mounted in an upwardly extending sleeve of the nut 26.

The plate and food thereon can be heated in a microwave oven prior to mounting on the support. Also, as shown in FIG. 4, resistive wires 43 in the plate 14 can be supplied by electrical current from the battery 40, or from solar cells, to generate heat to keep the food warm. An on-off switch 45 controls the current flow to the resistive wires 43.

As previously discussed, the stand can be mounted on a horizontal or a vertical support surface, on a person's body, and on any object, such as a vehicle. The stand can advantageously be mounted on a car console, especially one having built-in beverage or cup holders for receiving the lower end of the column.

As shown in FIG. 11, the plate 14 need not be supported at its central region, but could also be detachably supported at its outer peripheral region. Thus, a plurality of supports 140 are gathered together by a mounting sleeve 141. The supports 140 flare upwardly and outwardly from the sleeve and terminate in clips 142, each having a generally C-shaped cross-section defining a channel in which an edge portion of the plate 14 is received. FIG. 11A depicts the edge portion of the plate snugly received in the channel of a clip, whereas FIG. 11B depicts a modification in which the edge portion of the plate is spaced with clearance inside the channel and is supported from below by a ridge 143. Preferably, the supports are of a resilient material to enable the plate to be resiliently engaged. The supports 140 extend downwardly from the sleeve 141 and thereupon radially outwardly as legs 144 in a common plane to support the plate on a generally horizontal support surface. A beverage container may be inserted into a circular hole 146 extending through the plate 14.

Figure 12:
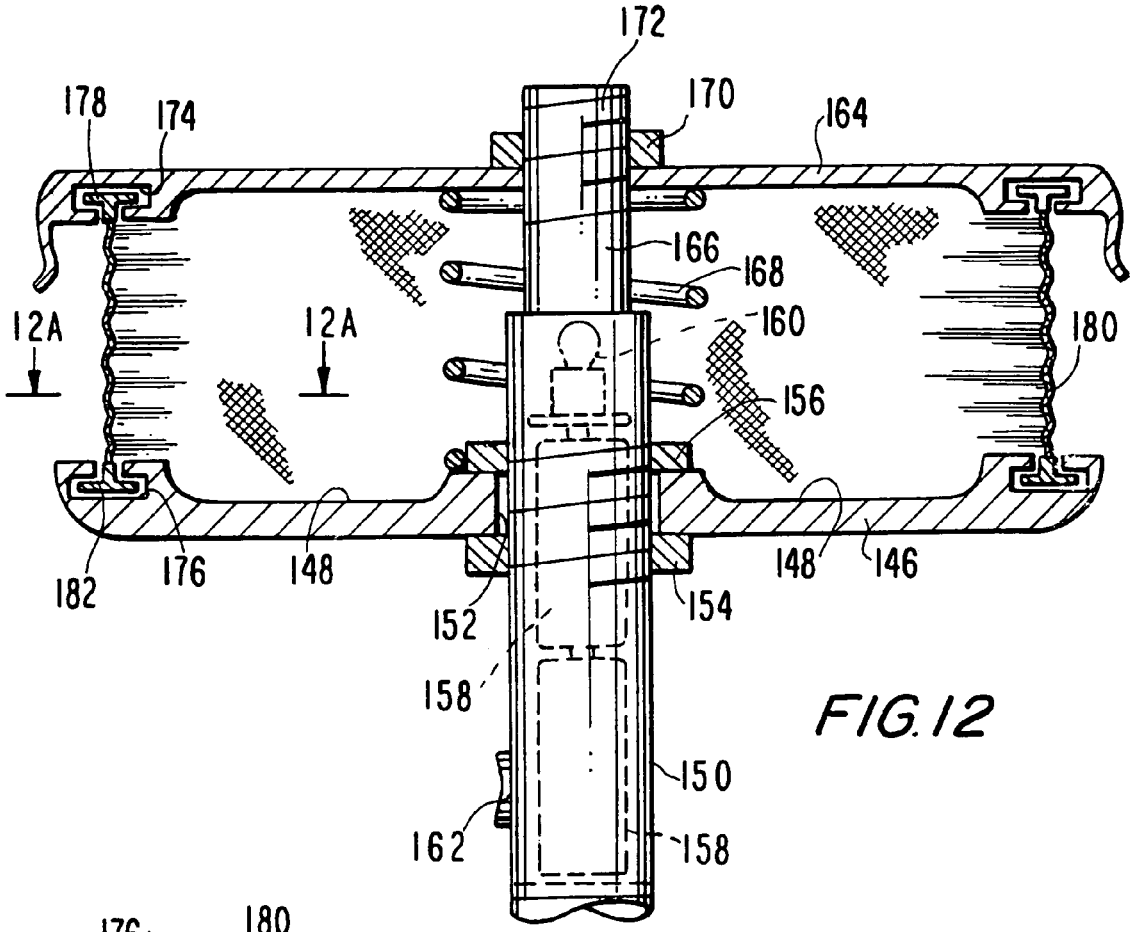
FIG. 12 is a sectional view of yet another embodiment of a plate stand according to this invention.

As shown in FIG. 12, a plate 146 having food depressions 148 is mounted on an upright column 150. The plate 146 has a central hole 152 through which the column extends. The plate is mounted between a pair of adjustable mounting elements 154, 156 and is free to rotate about the axis of the column.

A set of batteries 158 is mounted inside the column and supply electrical power to a bulb 160 also mounted within the column. When an electrical switch 162 is actuated, light is emitted from the bulb to provide local illumination. Preferably, the sidewall of the column surrounding the bulb is made of a light-transmissive material.

A curtained enclosure is mounted above the plate 146 and comprises a cover 164 mounted on an extension 166. A coil spring 168 surrounds the extension 166 and resiliently urges the cover 164 away from the plate 146. A nut 170 is threadedly engaged with a threaded end region 172 of the extension 166 and defines an end-limiting position for the cover.

The cover 164 has a circular track 174, and the plate 146 has a circular track 176, both tracks being in vertical alignment. A curtain 180, preferably made of a flexible material, has an upper runner 178 received in and slidable along track 174, and a lower runner 182 received in and slidable along track 176. The curtain advantageously has circular pleats giving it a bellows-like appearance.

Figure 12A:
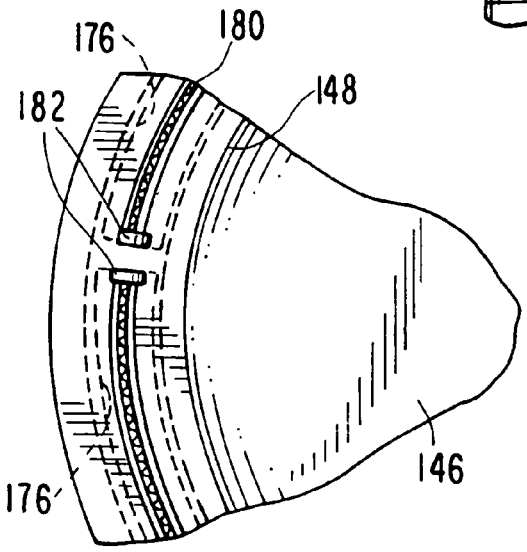
FIG. 12A is a sectional view taken on line 12A—12A of FIG. 12.

As shown in FIG. 12, the curtain 180 surrounds any food contained in the depressions 148 on the plate and serves to screen out dirt, dust and like contaminants, pests such as mosquitoes, and weather conditions such as rain and wind. The curtain also helps to maintain the temperature of the food. As shown in FIG. 12A, there is a break in the circular curtain 180 to enable a user to open the curtain by sliding the runners 178, 182 apart to any desired extent circumferentially of the axis of the column. The plate, as previously noted, can be rotated so that a particular food depression lies adjacent an opening formed by the opened curtain.

Figure 13:
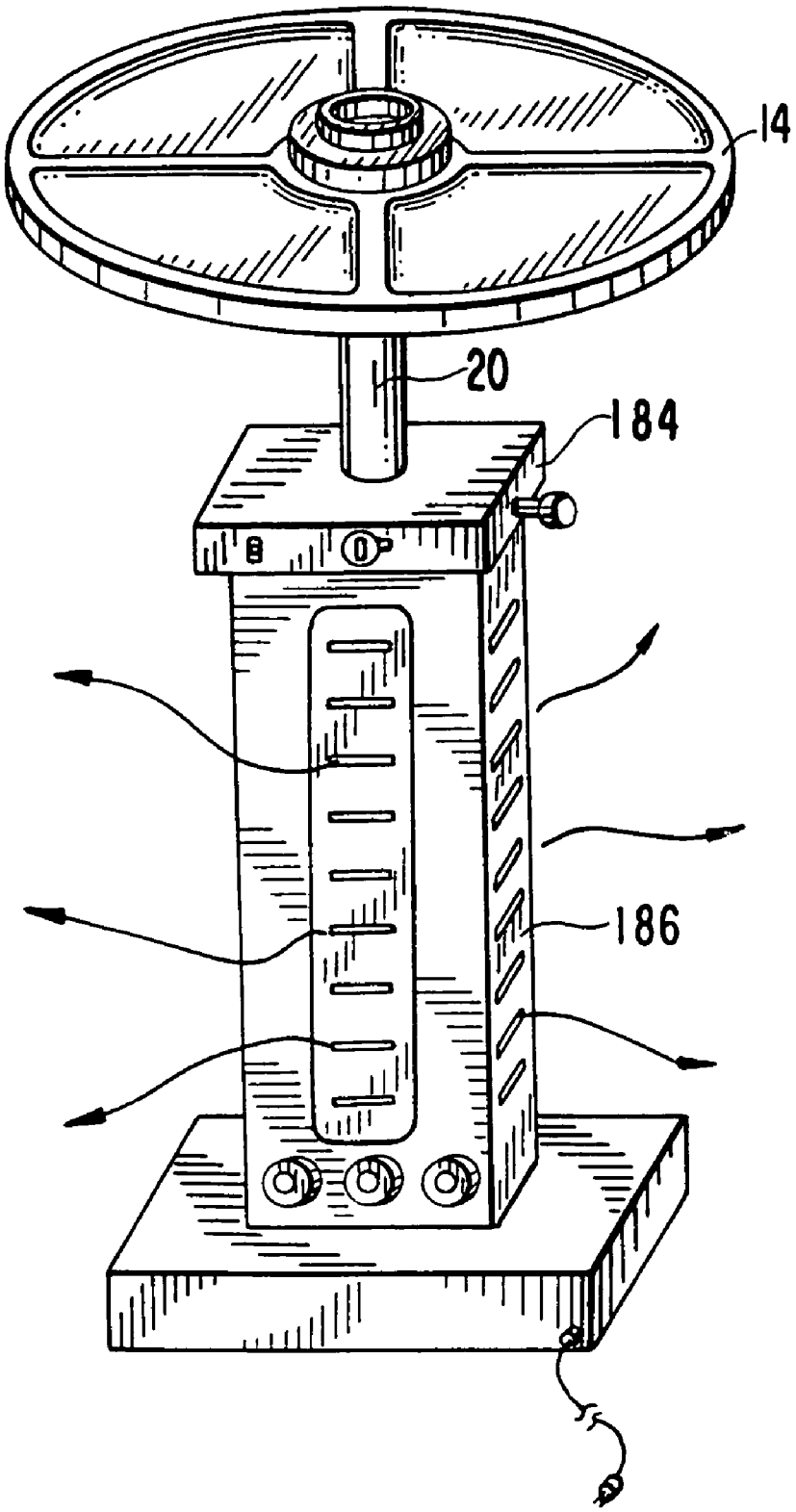
FIG. 13 is a perspective view of another embodiment of this invention.

FIG. 13 depicts the plate 14 mounted in the column 20 which, in turn, is mounted on an adapter 184. The adapter 184 can be mounted on a temperature unit 186 operative for either heating or cooling the surrounding environment of the plate.

FIG. 14 depicts the lower end of column 20 inserted in a powered housing 190 elevated above a floor by legs 192. As shown in FIG. 14A, the column 20 has a pair of electrical contacts 194, 196 which, when turned, make electrical contact with another pair of electrical contacts 202, 204 which, in turn, are connected to a power source via electrical wire 198 and plug 200. An insulating collar 206 is inserted in the housing 190 to prevent shorting of the electrical power. The power is useful for many purposes, such as the energization of a light source, or the temperature control over the food.

Alternatively, rather than employing an elevated housing 190, a plurality of sunken powered electrical outlets can be installed in the ground. Each outlet can have contacts similar to contacts 202, 204 for electrical connection to contacts on the column when the latter is inserted into the outlet.

FIG. 15 depicts the lower end of column 20 inserted into an adapter 210 which supports the column upright. The adapter 210 is mounted in a cupholder 212 provided in a vehicle, such as a car, boat, or plane, typically in a console or dashboard area. Thus, the adapter enables the plate stand to be conveniently supported anyplace where a cupholder exists.

It will be understood that each of the elements described above, or two or more together, also may find a useful application in other types of constructions differing from the types described above.

While the invention has been illustrated and described as embodied in a plate stand, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. A plate stand, comprising:

a) a column extending along a longitudinal axis between upper and lower end regions;

b) a base at the lower end region, for supporting the column in an upright orientation;

c) a plate having an upper surface, a lower surface, and at least one compartment;

d) a platform on the column above the base, for engaging the lower surface of the plate to support the plate from below the plate; and e) a clamping element mounted at the upper end region for axial movement between a clamped position in which the clamping element engages the upper surface of the plate and axially presses the plate against the platform to clamp the plate on the platform, and an unclamped position in which the plate is removable from the platform, the upper end region of the column being upwardly open in the clamped position.

2. The plate stand of claim 1, wherein the plate has a plurality of compartments for storing foods.

3. The plate stand of claim 1, wherein the plate is constituted of a disposable material.

4. The plate stand of claim 1, wherein the plate has a central opening extending between the upper and lower surfaces of the plate, and wherein the upper end region of the column extends through the central opening for engagement with the clamping element.

5. The plate stand of claim 4, wherein the upper end region of the column is threaded, and wherein the clamping element threadedly engages the upper end region of the column.

6. The plate stand of claim 5, wherein the clamping element has an annular internal thread.

7. The plate stand of claim 6, wherein the clamping element has opposite planar surfaces.

8. The plate stand of claim 6, wherein the clamping element has an upwardly open, concave shape symmetrical about the longitudinal axis.

9. The plate stand of claim 1, wherein the column is a single hollow cylinder with a diameter sized to be readily gripped in the palm of a user's hand.

10. The plate stand of claim 1, wherein the column includes a plurality of tubular cylindrical sections arranged for sliding lengthwise movement relative to one another, and a lock for locking the sections together.

11. The plate stand of claim 1, and a frusto-conical beverage container inserted into the upper end region of the column with a friction fit.

12. The plate stand of claim 11, wherein the clamping element has an upwardly open, concave shape symmetrical about the longitudinal axis, for collecting beverage escaped from the container.

* * * * *